US008740721B2

(12) United States Patent
Yamamoto

(10) Patent No.: US 8,740,721 B2
(45) Date of Patent: Jun. 3, 2014

(54) IRON-TYPE GOLF CLUB HEAD

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 295 days.

(21) Appl. No.: 13/272,919

(22) Filed: Oct. 13, 2011

(65) Prior Publication Data

US 2012/0122606 A1 May 17, 2012

(30) Foreign Application Priority Data

Nov. 17, 2010 (JP) ..... 2010-257087

(51) Int. Cl.
*A63B 53/08* (2006.01)

(52) U.S. Cl.
USPC ..... 473/312; 473/332; 473/334; 473/336; 473/337; 473/341; 473/350

(58) Field of Classification Search
USPC ..... 473/312, 332, 334, 336, 337, 341, 349, 473/350
See application file for complete search history.

(56) References Cited

U.S. PATENT DOCUMENTS

| | | | | |
|---|---|---|---|---|
| 3,961,796 | A * | 6/1976 | Thompson | 473/328 |
| 4,854,583 | A * | 8/1989 | Kobayashi | 473/312 |
| 5,205,552 | A * | 4/1993 | Green, Jr. | 473/312 |
| 6,080,069 | A * | 6/2000 | Long | 473/332 |
| 6,102,274 | A * | 8/2000 | Nagamoto | 228/114.5 |
| 6,962,538 | B2 * | 11/2005 | Roach et al. | 473/332 |
| 7,976,403 | B2 * | 7/2011 | Gilbert et al. | 473/309 |
| 8,206,237 | B2 * | 6/2012 | Gilbert et al. | 473/309 |
| 2006/0100033 | A1 * | 5/2006 | Nelson et al. | 473/349 |
| 2007/0129166 | A1 * | 6/2007 | Shimazaki et al. | 473/345 |
| 2009/0305815 | A1 | 12/2009 | Hirano | |
| 2010/0130306 | A1 * | 5/2010 | Schweigert | 473/350 |
| 2011/0028235 | A1 * | 2/2011 | Nakano | 473/332 |

FOREIGN PATENT DOCUMENTS

| | | | |
|---|---|---|---|
| JP | 2009-291488 | A | 12/2009 |
| JP | 2010-029380 | A | 2/2010 |

* cited by examiner

*Primary Examiner* — Benjamin Layno
(74) *Attorney, Agent, or Firm* — Birch, Stewart, Kolasch & Birch, LLP

(57) ABSTRACT

An iron-type golf club head comprises a head main portion having a face for hitting a golf ball, and weight members made of metallic material having heavier specific gravity than the head main portion. The head main portion has a tubular portion provided on a heel side of the face and having a shaft inserting hole. The tubular portion is provided continuously on the lower side of the shaft inserting hole with a bottomed hole part for arranging the weight members. The weight members include a heel-side weight member disposed in the bottomed hole part.

7 Claims, 9 Drawing Sheets

X - X end face

Y - Y end face

Z - Z end face

IRON-TYPE GOLF CLUB HEAD

BACKGROUND OF THE INVENTION

1. Field of the Invention

The present invention relates to an iron-type golf club head having improved directional stability of a hit golf ball.

2. Description of the Background Art

In recent years, an iron-type golf club head a position of whose center of gravity was improved by bonding more than two kinds of different metallic materials has been proposed. FIG. 10 shows one example of such an iron-type gold club head a. The club head a includes a main portion b, and weight members ct, ch having heavier specific gravity than the main portion b, the weight members ct, ch being respectively arranged in a lower part of a toe portion t and a heel portion h on a rear of a face portion of the main portion b. In this type of club head a, great mass is allocated to a toe side and a heel side of a face portion. Hence, a moment of inertia around a vertical axis passing through the center of gravity of the head G (which may be hereinafter referred to as the "moment of inertia Ig") increases, and orientation of a face does not easily change even when a golf ball is hit on the toe side or the heel side of a sweet spot of the face, thus improving the directional stability of the hit golf ball.

However, the gold club head mentioned above tends to have a greater moment of inertia around an axial centerline CL of a shaft (which may be hereinafter referred to as the "moment of inertia Ic"). Such a golf club head a having the great moment of inertia Ic originally had a problem that when a golfer swung it, the face did not fully return to the position at address, thus causing him/her to easily make a slice shot. There are related technologies as shown below:

[Patent Document 1] Japanese Patent Application Publication No. 2010-29380,

[Patent Document 2] Japanese Patent Application Publication No. 2009-291488.

SUMMARY OF THE INVENTION

The present invention has been devised in light of the above actual circumstances, and a principal object of the present invention is to provide an iron-type golf club head with excellent directional stability of a hit golf ball, basically by providing a bottomed hole part on the lower side of a shaft inserting hole of a head main portion and arranging a heel-side weight member in the bottomed hole part, thereby minimizing an increase in the moment of inertia Ic while making the moment of inertia Ig greater.

In accordance with the present invention, there is provided an iron-type golf club head, comprising:

a head main portion having a face for hitting a golf ball and a tubular portion provided on a heel side of the face and having a shaft inserting hole, and weight members made of a metallic material having heavier specific gravity than that of the head main portion, wherein the tubular portion is provided continuously on the lower side of the shaft inserting hole with a bottomed hole part for arranging the weight members, and the weight members include a heel-side weight member disposed in the bottomed hole part.

In the iron-type golf club head of the present invention, a bottomed hole part is provided continuously on the lower side of a shaft inserting hole, and a heel-side weight member is arranged in the bottomed hole part. Thus, great mass can be allocated to a lower part of the heel side of the head. Such an iron-type golf club head can obtain a greater moment of inertia Ig. In addition, since the heel-side weight member is arranged in the lower side of the shaft inserting hole, a shaft axial centerline comes close to a center of gravity of the heel-side weight member. That is to say, any increase in the moment of inertia Ic can be controlled while ensuring the great moment of inertia Ig. Therefore, with the club head of the present invention, when swinging, a golfer can easily return a face to the position at address. In addition, since orientation of the face does not easily change when the golfer mishits a shot, directional stability of a hit golf ball improves. Furthermore, since the heel-side weight member is arranged on the lower side of the head, the golf club has a lower center of gravity. In addition, since the heel-side weight member is arranged in the bottomed hole part which is provided on the lower side of the shaft inserting hole, it does not come off from a head main portion even under action of centrifugal force during a swing. Furthermore, since the bottomed hole part is continuously provided in the shaft inserting hole, the golf club head has good workability and is excellent in productivity.

DESCRIPTION OF THE PREFERRED EMBODIMENTS

An embodiment of the present invention will be described hereinafter with reference to the drawings.

Figure 1:
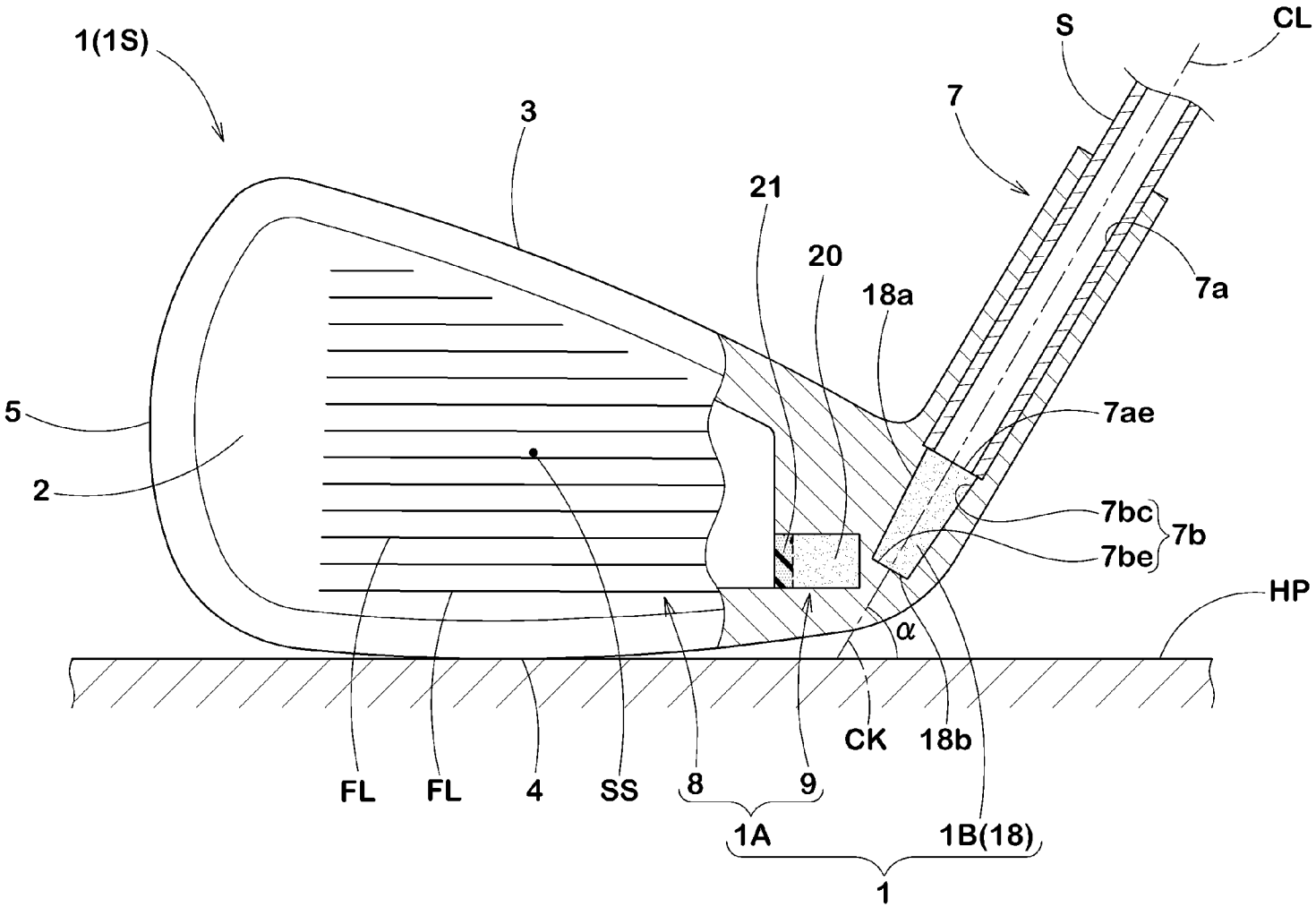
FIG. 1 is a front elevational view of a reference condition of an iron-type golf club head according to one embodiment of the present invention.
Figure 2:
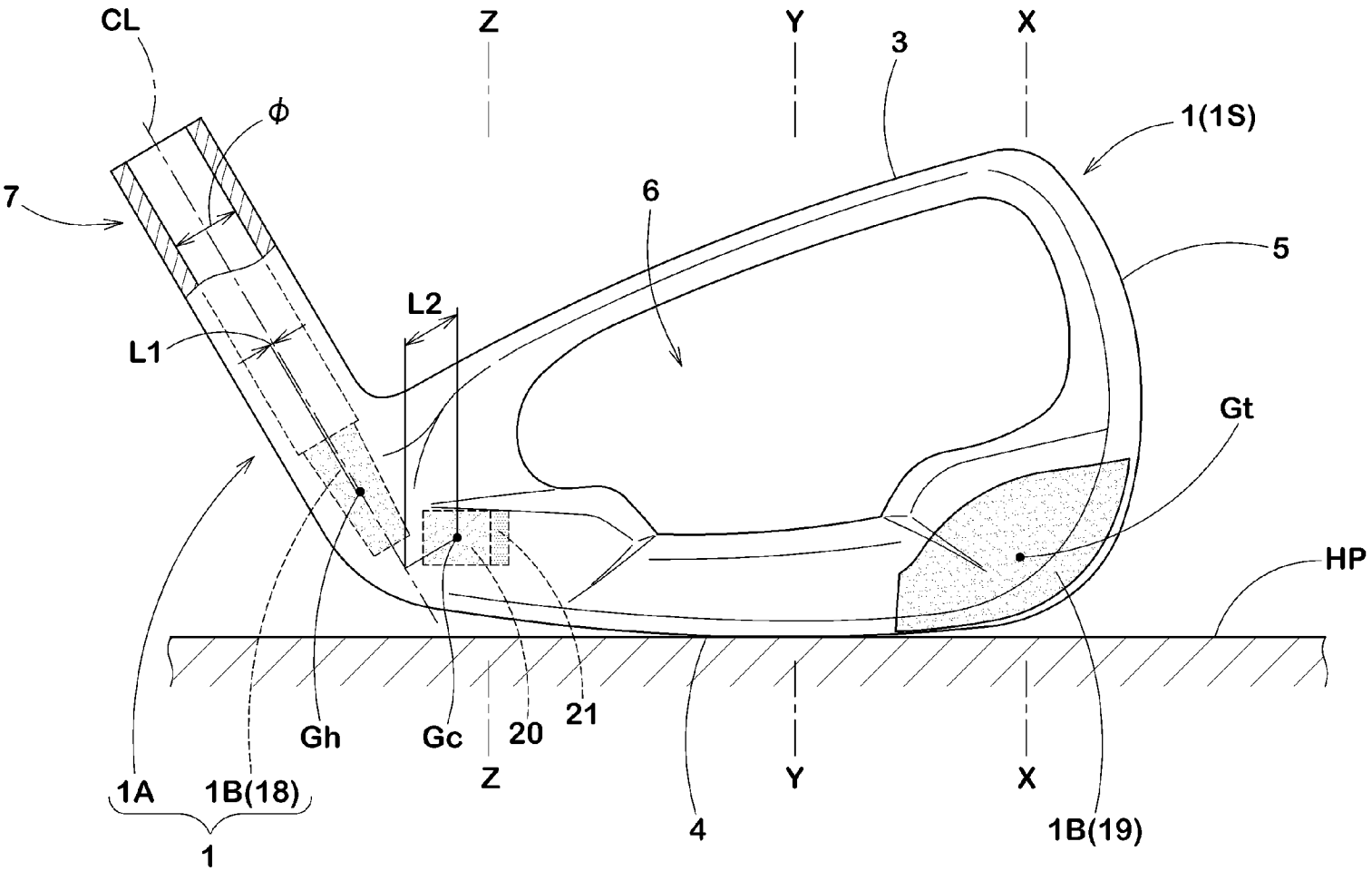
FIG. 2 is a rear elevational view thereof.

In FIG. 1 and FIG. 2, an iron-type gold club head (which may be hereinafter simply referred to as a "head" or "club head") 1 has:

a face 2 which hits a golf ball and is substantially planar;

a top surface 3 which continues to an upper edge of the face 2 and forms a head top;

a sole surface 4 which continues to a lower edge of this face 2 and forms a head bottom face;

a toe surface 5 which smoothly curves between and connects the top surface 3 and the sole surface 4;

a back face surface 6 which forms an opposite surface to the face 2; and a tubular portion 7 having a shaft inserting hole 7*a* into which a shaft S is mounted.

In addition, when the shaft S is not mounted, the lie angle $\alpha$ of the head 1 can be based on a axial centerline CL of the shaft inserting hole 7*a*.

In addition, the head 1 shall be placed in a reference condition. The reference condition refers to a condition in which the head 1 is in contact with a horizontal plane HP, while the head 1 is being held at its predetermined lie angle $\alpha$ and loft angle β. The club head 1 shall be placed in this reference condition, unless otherwise mentioned.

In addition, the club head 1 of the embodiment is configured to include a head main portion 1A integrally having the face 2 and the tubular portion 7 which is continuously provided on the heel side of the face 2, and weight members 1B made of a metallic material having heavier specific gravity than the head main portion 1A.

The head main portion 1A is configured to include, for example, a face plate 8 which constitutes a main part of the face 2, and a face receiving frame portion 9 which only supports a periphery of the face plate 8. Now, the main part of the face 2 means at least 60% of an area of the face 2, more preferably 70% or more, and even more preferably 75% or more.

It is desirable that the face plate 8 is made of a metallic material having high specific strength and excellent resilience. In addition, it is preferred that the face receiving frame portion 9 is made of a metallic material which is different from that of the face plate 8 and has especially higher specific gravity than that of the face member 8. Then, for the face plate 8 and the face receiving frame portion 9, various metallic materials such as titanium, a titanium alloy, an aluminum alloy, stainless steel, or soft iron, for example, may be adopted.

As with the embodiment, if the head main portion 1A is formed of more than two kinds of materials, the specific gravity of the head main portion 1A shall be average specific gravity, and is calculated by being weighted by each of volume of the face plate 8 and that of the face receiving frame portion 9. Then, in order to ensure volume needed for the head 1 while ensuring easiness to swing, it is desirable that the specific gravity ρ1 of the head main portion 1A is preferably 5.0 or higher and more preferably 6.0 or higher, or preferably 8.0 or lower and more preferably 7.0 or lower.

In addition, as with the embodiment, if the head main portion 1A is formed of two kinds of metallic materials, from the standpoint of providing a head 1 with a greater moment of inertia or a large sweet area, it is desirable that the specific gravity ρ2 of the face plate 8 is preferably 2.0 or higher and more preferably 4.0 or higher, or preferably 5.0 or lower and more preferably 4.7 or lower. In addition, it is desirable that the specific gravity ρ3 of the face receiving frame portion 9 is preferably 7 or higher and more preferably 7.5 or higher, or preferably 9.0 or lower and more preferably 8.0 or lower.

While a titanium alloy is adopted for the face plate 8 of the embodiment, stainless steel whose specific gravity is heavier than the titanium alloy is used for the face receiving frame portion 9. With this, more weight is allocated to the periphery of the face plate 8, which thus provides the head 1 having the great moment of inertia or a large sweet area. In addition, it is needless to say that a combination of the metallic materials in the face plate 8 and the face receiving frame portion 9 may be changed variously. In addition, the head main portion 1A may be configured by one kind of metallic material.

Figure 3:
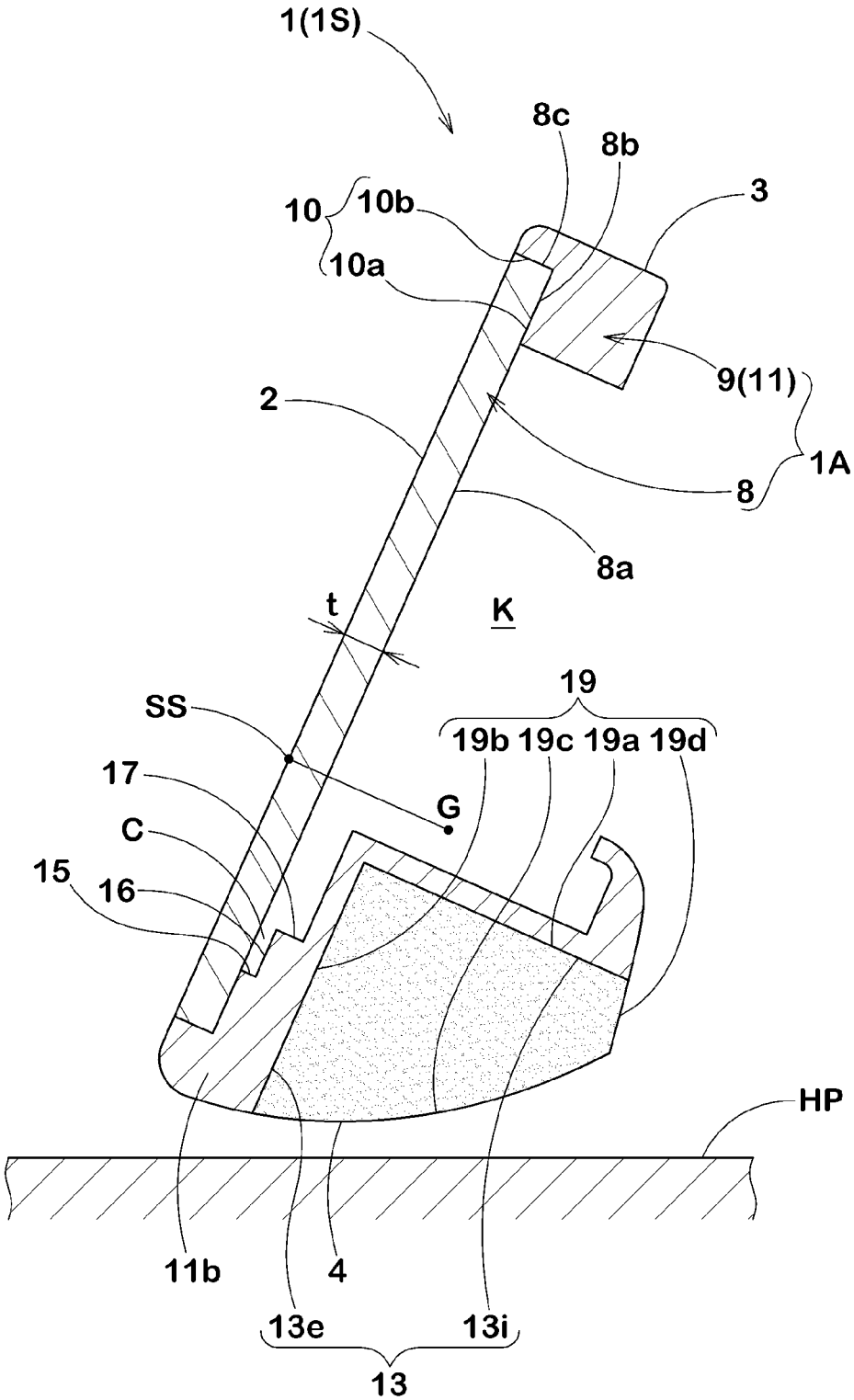
FIG. 3 is an enlarged end view of X-X of FIG. 2.
Figure 4:
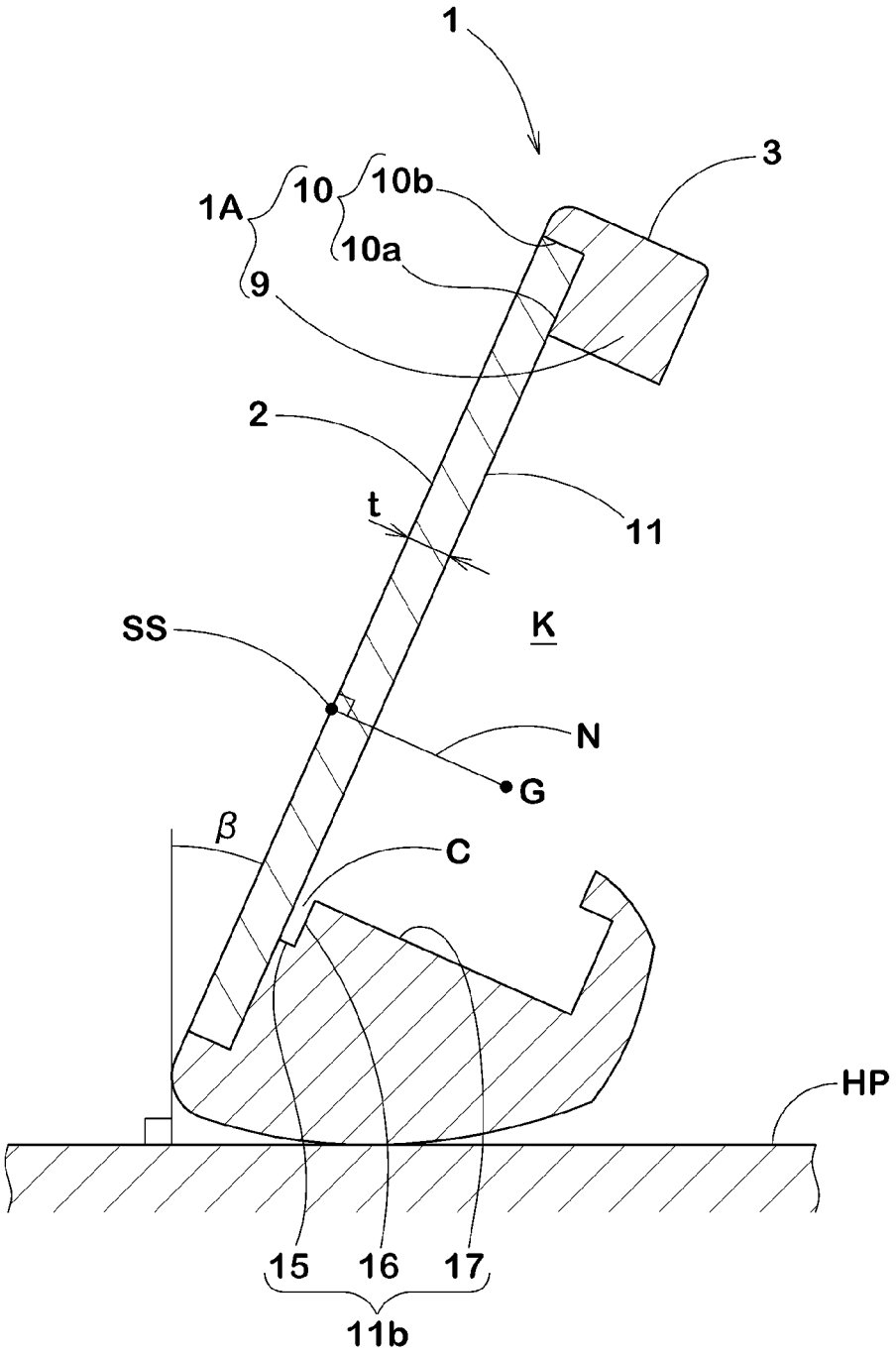
FIG. 4 is an enlarged end view of Y-Y of FIG. 2.
Figure 5:
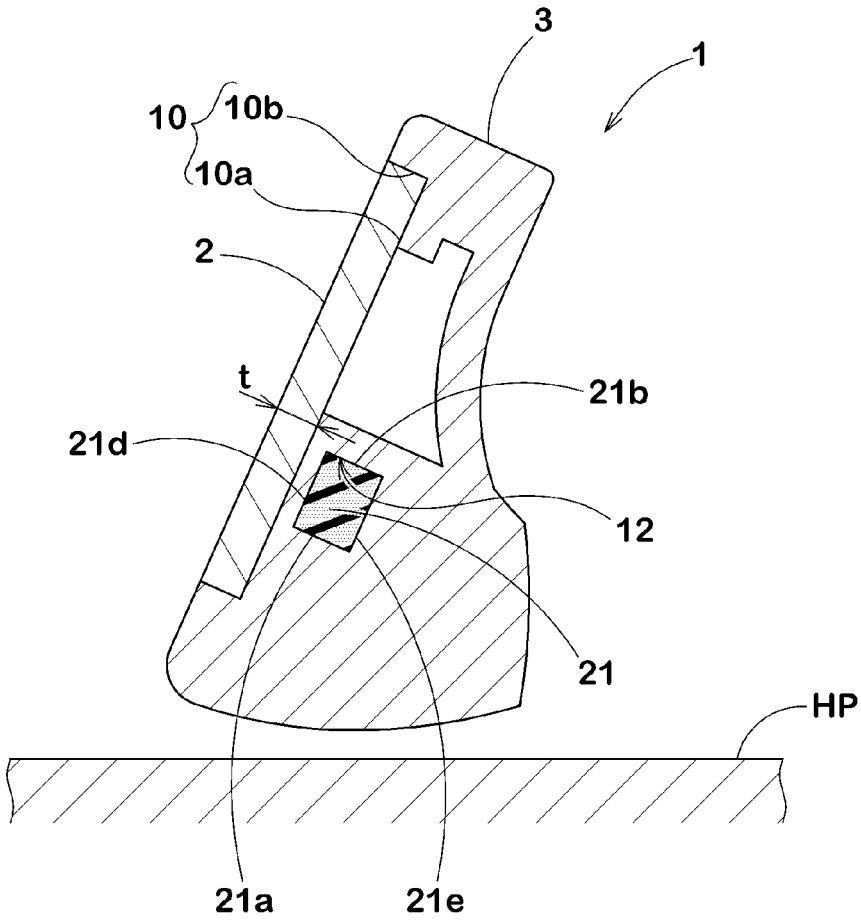
FIG. 5 is an enlarged end view of Z-Z of FIG. 2.

As shown in FIG. 3 to FIG. 5, the face plate 8 of the embodiment is formed to have substantially fixed thickness t. There is a tendency that resilience of the head drops when the thickness t of the face plate 8 is too great, and that strength is insufficient when it is too small, thus aggravating durability. Thus, it is desirable that the thickness t is preferably 2.0 mm or greater and more preferably 2.2 mm or greater, or preferably 3.0 mm or smaller and more preferably 2.8 mm or smaller. In addition, the thickness of the face plate 8 may vary. For example, it may progressively or continuously decrease or vice versa toward a midportion.

It is preferable that height of a contour shape of the face plate 8 gradually increases from the heel side to a toe side in accordance with a contour of the face 2, for example. In addition, conventionally, on the face 2, a plurality of face lines FL such as a concave groove for increasing friction force with a golf ball are provided at intervals.

As shown in FIG. 3 to FIG. 6, the face receiving frame portion 9 is configured to include an outer peripheral frame 11 on which a face mounting portion 10 to a front side of which the face plate 8 is mounted, and the tubular portion 7 which is continuously provided on the heel side of the outer peripheral frame 11.

The outer peripheral frame 11 includes:

a top portion frame 11*a* which extends obliquely downward on the head top from the toe side to the heel side;

a sole portion frame 11*b* which extends on the head bottom to the toe and heel directions;

a toe portion frame 11*c* which connects therebetween on the toe side;

a heel portion frame 11*d* which connects on the heel side the top portion frame 11*a* and the sole portion frame 11*b*; and an opening O which is surrounded by the top portion frame 11*a*, the toe portion frame 11*c*, the sole portion frame 11*b*, and the heel portion frame 11*d*, and which penetrates the head in a front-back direction.

Around the opening O is provided the face mounting portion 10. As shown in FIG. 3 and FIG. 4, the face mounting portion 10 is formed in an almost step-like manner, including an annular receiving surface 10*a* which only supports a periphery 8*b* of a rear 8*a* of the face plate 8, and an inner peripheral surface 10*b* which extends from an outer peripheral edge of the receiving surface 10*a* and holds an outer peripheral surface 8*c* of the face plate 8, for example. Then, the face plate 8 and the face receiving frame portion 9 are integrated by joining means such as welding, brazing, caulking, an adhesive and/or a screw. In addition, when the face plate 8 is mounted to the face mounting portion 10, the opening O is closed, and on the rear side of the face plate 8 is formed a cavity K surrounded by the outer peripheral frame 11.

The sole portion frame 11*b* includes:

a small wall part 15 which extends from an upper end of the receiving surface 10*a* of the face mounting portion 10, behind the head in a small length;

a back wall part 16 which forms a small clearance c between the small wall part 15 and the rear 8*a* by standing upward from a back end of the small wall part 15; and a sole wall part 17 which extends from the upper end of the back wall part 16 behind the head. Such a cavity structure serves to position a head center of gravity G more backward.

As shown in FIG. 1, in the tubular portion 7 are provided the shaft inserting hole 7*a*, and the bottomed hole part 7*b* which is continuously provided on the lower side of the shaft inserting hole 7*a* and in which the weight member 1B is disposed.

The shaft inserting hole 7*a* is formed like a cylinder which has a circular cross section, for example, and whose inner diameter ϕ continues along an axial centerline CL of the shaft inserting hole 7*a* and substantially identically thereto.

The bottomed hole part 7*b* is provided continuing to a lower edge 7*ae* of the shaft inserting hole 7*a*. In addition, the bottomed hole part 7*b* of the embodiment has a circular cross section and forms a cone-shaped space having an inner side 7*bc* which extends from the lower edge 7*ae* of the shaft inserting hole 7*a* to the sole surface in a tapered manner, and a bottom face 7*be* which terminates inside the heel frame portion 11*d*. Furthermore, the bottomed hole part 7*b* of the embodiment is such formed that its axial centerline CK is coaxial with the axial centerline CL of the shaft. In addition, the weight member 1B to be arranged in the bottomed hole part 7*b* has an outer diameter which enables insertion from the shaft inserting hole 7*a*. Therefore, in order to eliminate any jolt in the weight member 1B and the bottomed hole part 7*b*, it is desirable that a maximum diameter of the bottomed hole part 7*b* is formed to be identical to an inner diameter of the shaft inserting hole 7*a* or smaller than it.

The bottomed hole part 7*b* as described above may be formed, for example, when the face receiving frame portion 9 may be cast and molded, or may be drilled by forming only the shaft inserting hole 7*a* by casting, and then inserting a drill or the like therefrom. Such a bottomed hole part 7*b* has good workability and is excellent in productivity.

As shown in FIG. 1, the weight member 1B includes a heel-side weight member 18 which is arranged in the bottomed hole part 7*b*. Such a club head 1 has a great moment of inertia Ig because great mass is allocated to a lower part of the heel side of the head 1. Thus, the club head 1 controls movement of the face when a golfer mishits a shot, and improves directional stability of the hit golf ball.

In addition, since the heel-side weight member 18 is arranged on the lower side of the shaft inserting hole 7*a*, its center of gravity Gh comes close to an axial centerline CL of the shaft inserting hole 7*a*. Such a club head 1 controls an increase in the moment of inertia Ic around the shaft axis, while making the moment of inertia Ig greater. Therefore, the club head 1 of the present invention enables a golfer to easily return the face to the position at address when he/she swings, while maintaining the action that orientation of the face does not easily change if he/she mishits a shot. Thus, the directional stability of a hit golf ball further improves.

The heel-side weight member 18 of the embodiment has an outer peripheral surface 18*a* which faces the inner side 7*bc* of the bottomed hole part 7*b*, and an underside 18*b* which faces the bottom face 7*be* of the bottomed hole part 7*b*, and forms a cone shape which almost matches a shape of the bottomed hole part 7*b*. Thus, the heel-side weight member 18 can be easily inserted into the bottomed hole part 7*b* from the shaft inserting hole 7*a*, and reduce any jolt with the bottomed hole part 7*b* after being inserted. Therefore, the golf club head 1 of the embodiment is not only excellent in productivity, but also can prevent any sound ringing due to a collision of the heel-side weight member 18 and the bottomed hole part 7*b* during a swing. Preferably, the heel-side weight member 18 and the bottomed hole part 7*b* are firmly bonded by an adhesive or brazing or the like, for example.

A center of gravity Gh of the heel-side weight member 18 in this example lies on an extended line of the axial centerline CL of the shaft inserting hole 7*a*. Such a club head 1 can further reliably control an increase in the moment of inertia Ic, thus further improving the directional stability of a hit golf ball. As such, in the most preferred aspect, the shortest distance L1 between the shaft axial centerline CL and the center of gravity Gh of the heel-side weight member 18 is substantially zero (a slight error in manufacturing may be allowed). However, the distance L1 can sufficiently achieve the above action if it is 1.0 mm or smaller, and more preferably 0.5 mm or smaller.

In the embodiment, the heel-side weight member 18 is bonded to the bottomed hole part 7*b*, and then the shaft S is bonded by being inserted into the shaft inserting hole 7*a*. In the embodiment, the bottomed hole part 7*b* is formed so as to have a slightly smaller diameter than the shaft inserting hole 7*a*. With this, not only a lower position of the shaft S is regulated by a step of the lower edge 7*ae* of the shaft inserting hole 7*a*, but also the heel-side weight member 18 can be controlled at the lower edge of the shaft S. In addition, it is preferable to have a bush or the like for absorbing impact interposed between the shaft S and the heel-side weight member 18.

Such a heel-side weight member 18 does not come off from the head main portion 1A even under action of centrifugal force during a swing. In particular, the heel-side weight member 18 and the bottomed hole part 7*b* of the embodiment are formed in a cone shape which tapers toward a sole side of the head 1. Thus, during a swing, due to the centrifugal force, the heel-side weight member 18 is subjected to force in a direction further getting into the bottomed hole part 7*b* and is less likely to come off from the head main portion 1A. In addition, the heel-side weight member 18 is covered by the head main portion 1A and the shaft S, and not exposed to the outside. Therefore, it does not exercise any mental influence on a player.

In addition, the bottomed hole part 7*b* may have a cylinder or quadratic prism shape, for example. In addition, a thread groove which makes the outer peripheral surface 18*a* of the heel-side weight member 18 and the inner side 7*bc* of the bottomed hole part 7*b* engage with each other may be formed, so that both can be joined as a pair of screws.

Figure 6:
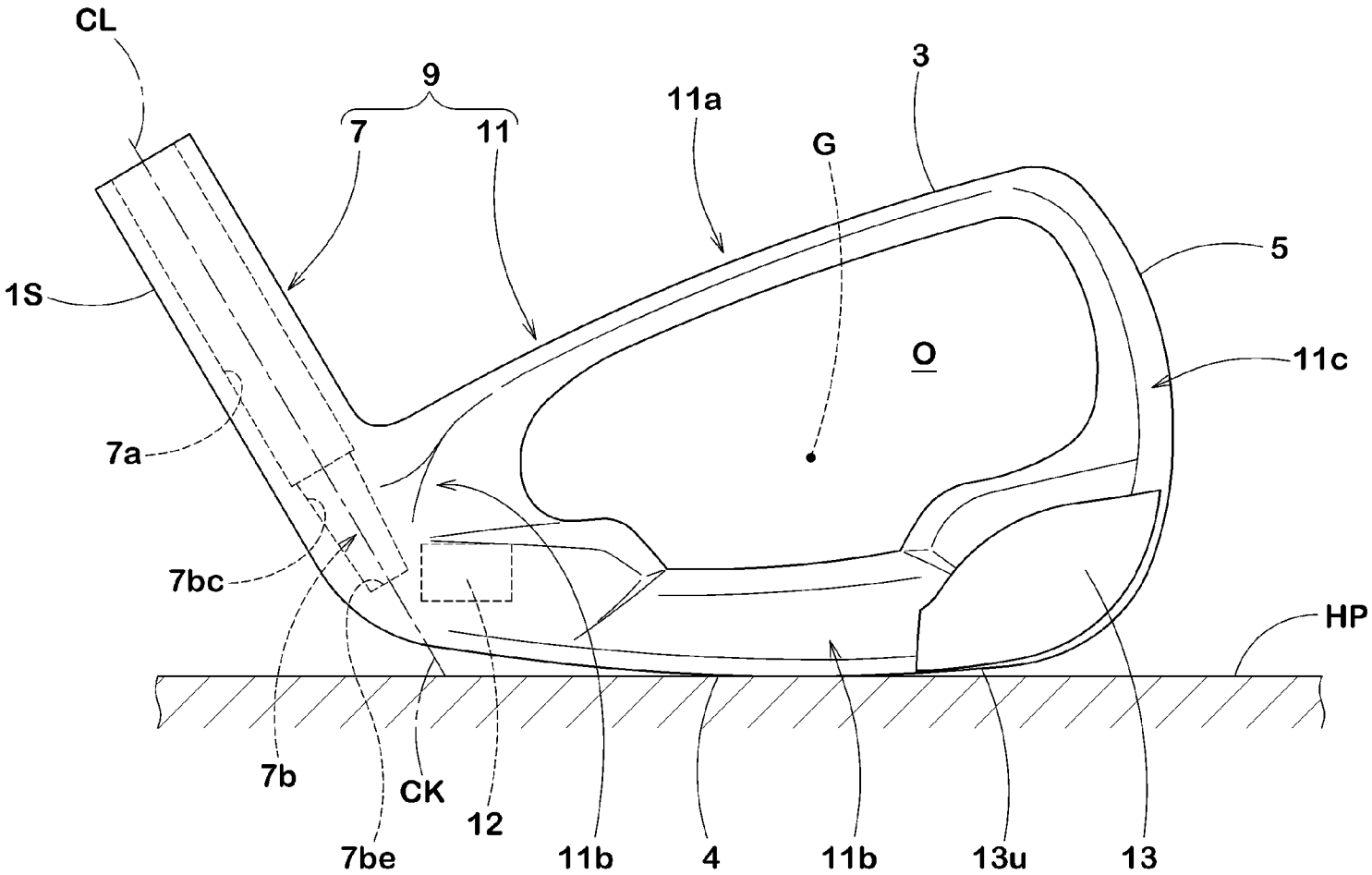
FIG. 6 is a rear elevational view of a face receiving frame portion.

Also as shown in FIG. 3 and FIG. 6, the weight member 1B of the embodiment includes a toe-side weight member 19 arranged on the toe side of the head main portion 1A. In the head 1 of the embodiment, a concave portion 13 is provided on the toe side of the sole portion frame 11*b*, and the toe-side weight member 19 is bonded to the concave portion 13.

A shape of the concave portion 13 should not be limited by any means, as far as it gets dented from an outer surface of the finished club head 1. The concave portion 13 of the embodiment forms an internal corner consisting of a bottom face 13*e* which is substantially parallel to the face 2 and a downward surface 13*i* which continues to the bottom face 13*e* and extends behind the head substantially orthogonally from the bottom face 13*e*, and opens in the sole surface 4 and the back face surface. In addition, the concave portion 13 of the embodiment is provided closer to the toe side than a sweet spot SS and on the head bottom side. In addition, as shown in FIG. 4, the sweet spot SS shall bean intersecting point of a normal N which stands on the face 2 from the head center of gravity G, and the face 2.

The toe-side weight member 19 has an upside 19*a* bonded to the downward surface 13*i* of the concave portion 13, a front 19*b* bonded to the bottom face 13*e* of the concave portion 13, a bottom face 19*c* exposed to the sole surface 4, and a back 19*d* exposed to the back face surface. In the embodiment, the toe-side weight member 19 and the concave portion 13 are firmly bonded by welding, for example. Such a toe-side weight member 19 is provided closer to the toe side than the sweet spot SS and on the sole surface side. This serves not only to lower the center of gravity of the head 1, but also to make the moment of inertia Ig greater in cooperation with the heel-side weight member 18.

Each specific gravity ρ4 of the heel-side weight member 18 and the toe-side weight member 19 shall not be specifically limited. However, if it is too small, great mass may not be possibly allocated to the toe side and the heel side. On the contrary, if it is too great, manufacturing cost may increase. From such a standpoint, it is desirable that the specific gravity ρ4 is preferably 8 or greater and more preferably 9 or greater, or preferably 19 or smaller and more preferably 18 or smaller.

The specific gravity of the heel-side weight member 18 and that of the toe-side weight member 19 may be the same or different. In the embodiment, due to a relation of forming positions, volume of the heel-side weight member 18 is formed to be smaller than that of the toe-side weight member 19. In order to bring the mass of both closer to each other and make the moment of inertia Ig greater, it is preferable that the specific gravity ρ4*h* of the heel-side weight member 18 is greater than the specific gravity ρ4*t* of the toe-side weight member 19 within the range of specific gravity. Such a club head 1 has a good mass balance on the heel side and the toe side, and can make the moment of inertia Ig greater.

In addition, in order to effectively achieve operation and effect described above, it is desirable that the mass of the heel-side weight member 18 is preferably 7 g or more and more preferably 11 g or more, or preferably 15 g or less and more preferably 13 g or less. Similarly, it is desirable that the mass of the toe-side weight member 19 is preferably 30 g or more and more preferably 40 g or more, or preferably 70 g or less and more preferably 60 g or less.

As such a material of weight members 18, 19, one kind or two or more kinds of metallic material (s) such as stainless, tungsten, a tungsten alloy, a copper alloy, a nickel alloy or the like is(are) preferred. For the weight members in the embodiment, a tungsten alloy containing tungsten, stainless steel, and nickel is adopted.

If the moment of inertia Ig of the club head 1 of the embodiment excessively increases, the mass of the head 1 also increases, which thus tends to aggravate a swing balance. On the contrary, if it is too small, orientation of the face easily changes when a golfer mishits a shot, which thus tends to aggravate the directional stability of the hit golf ball. From such a standpoint, it is desirable that the moment of inertia Ig is preferably 2700 $g \cdot cm^2$ or greater and more preferably 2900 $g \cdot cm^2$ or greater, or preferably 4000 $g \cdot cm^2$ or smaller and more preferably 3500 $g \cdot cm^2$ or smaller.

Similarly, if the moment of inertia Ic increases, the face does not fully return to the position at address when a golfer swings, and thus he/she tends to easily make a slice shot. On the contrary, if the moment of inertia Ic becomes small, return of the head excessively improves, the face returns beyond the position at address, and then the golfer tends to easily hook a shot. From such a standpoint, it is desirable that the moment of inertia Ic is preferably 5800 $g \cdot cm^2$ or greater and more preferably 6100 $g \cdot cm^2$ or greater, or preferably 6800 $g \cdot cm^2$ or smaller and more preferably 6500 $g \cdot cm^2$ or smaller.

Figure 7:
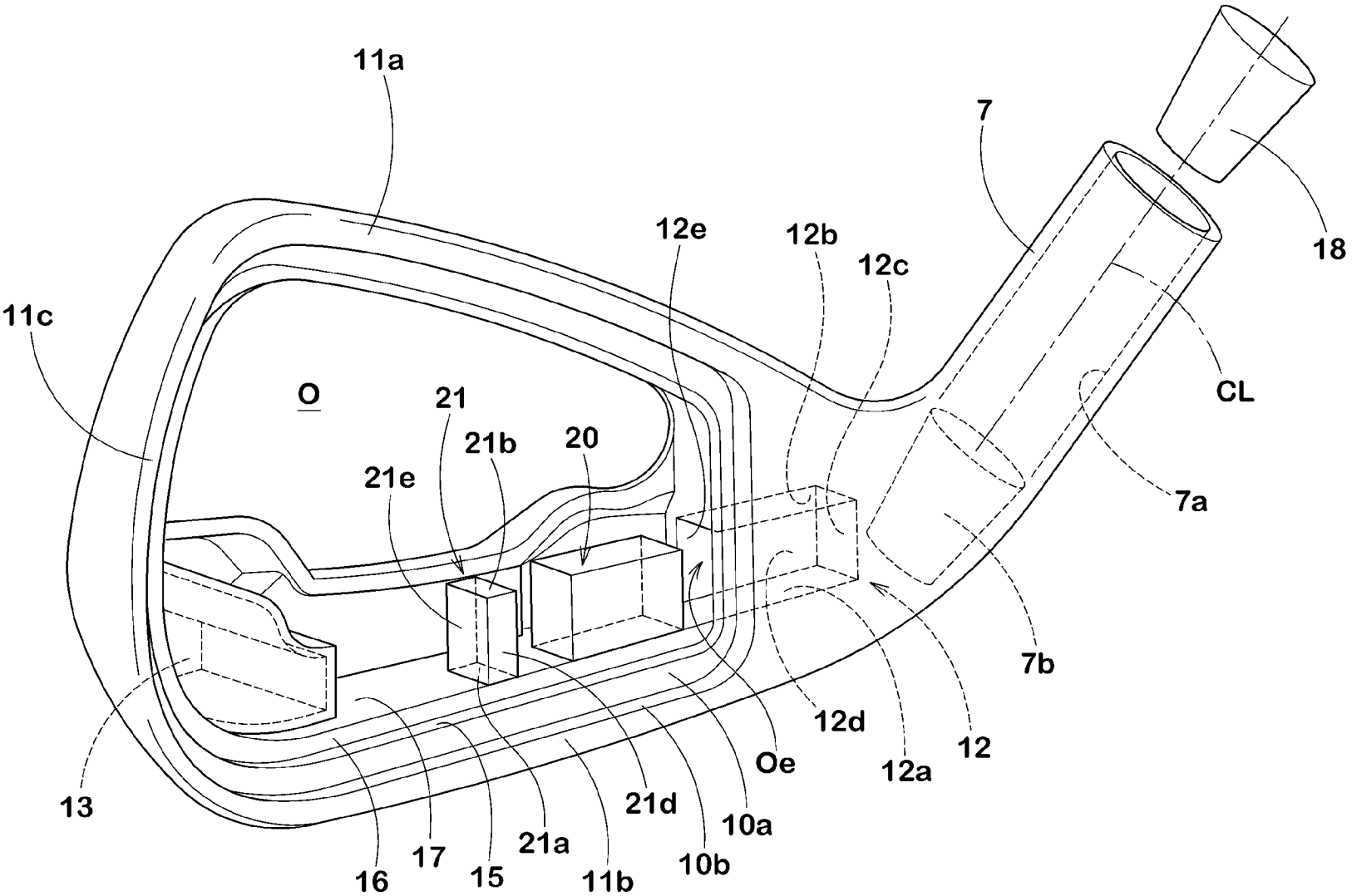
FIG. 7 is a perspective view of a head main portion of the embodiment.

In addition, as shown in FIG. 7, in the head 1 of the embodiment, on the face receiving frame portion 9 is formed a heel-side hollow portion 12 whose front/back and top/bottom are closed by extending from the opening O through the inside of the face receiving frame portion 9 to the heel side.

The hollow portion 12 is formed as a space shaped like a horizontally long quadratic prism, having an underside 12*a* on the sole side, an upside 12*b* on the top side, a bottom face 12*c* on the heel side, a front 12*d* on the face side, and a rear 12*e* on the back face side. The hollow portion 12 terminates at the bottom face 12*c* in the face receiving frame portion 9. Such a face receiving frame portion 9 reduces weight of the head main portion 1A, and can create a great weight margin needed for designing weight allocation. In addition, it is needless to say that the hollow portion 12 may have a shape of a cylinder or a cone which extends to the heel side, and may be changed into various aspects.

It is desirable that volume V1 of the hollow portion 12 is preferably 0.2 $cm^3$ or more and more preferably 0.4 $cm^3$ or more. This enables an adequate space to be formed on the heel side of the head main portion 1A and a great weight margin to be ensured. In addition, it is desirable that volume V1 of the hollow portion 12 is preferably 1.0 $cm^3$ or less and more preferably 0.6 $cm^3$ or less. When the volume V1 increases, strength of the head main portion 1A on the heel side may be possibly reduced, thus aggravating durability.

In the embodiment of FIG. 1, in the hollow portion 12 is arranged an intermediate weight member 20 consisting of a metallic material whose specific gravity is heavier than the face receiving frame portion 9. The intermediate weight member 20 of the embodiment is formed like a quadratic prism having an outer peripheral surface that faces the underside 12*a*, the upside 12*b*, the bottom face 12*c*, the front 12*d*, and the rear 12*e* of the hollow portion 12. Since such a head 1 can allocate a heavier object on the heel side, it can make the moment of inertia Ig greater, while controlling an increase in the moment of inertia Ic. In addition, since the front/back and the top/bottom of the hollow portion 12 are closed, besides being able to prevent degradation of strength of the head main portion, this can also prevent the intermediate weight member 20 from being displaced forward/backward or up/down when a golf ball is hit, thereby allowing improved durability.

As shown in FIG. 2, it is desirable that the shortest distance L2 between a center of gravity Gc of the intermediate weight member 20 and the axial centerline CL of the shaft inserting hole 7*a* is preferably 10 mm or greater and more preferably 12 mm or greater. If the distance L2 becomes excessively small, wall thickness of a wall portion which separates the bottomed hole part 7*b* and the hollow portion 12 becomes small, which thus tends to aggravate durability. On the contrary, if the distance L2 increases, the moment of inertia Ic excessively increases, thus possibly aggravating the directional stability of a hit golf ball. Therefore, it is desirable that the distance L2 is preferably 15 mm or less and more preferably 14 mm or less.

In addition, the intermediate weight member 20 is preferably made of a metallic material similar to that of the weight member 1B. That is to say, specific gravity ρ5 of the intermediate weight member 20 is preferably 9 or greater and more preferably 15 or greater, or preferably 25 or smaller and more preferably 20 or smaller. It is also desirable that mass of the intermediate weight member 20 is preferably 2 g or more and more preferably 4 g or more, or preferably 15 g or less and more preferably 10 g or less.

In addition, as shown in FIG. 1, in the head 1 of the embodiment, an elastic body 21 for absorbing vibration when a golf ball is hit is disposed in the hollow portion 12. The elastic body 21 of the embodiment is disposed such that it covers the interior of the hollow portion 12 and the toe side of the intermediate weight member 20. Such a club head 1 improves hit feeling because the elastic body 21 quickly absorbs vibration of the face plate 8 resulting from a golfer hitting a golf ball.

In addition, by including a downward surface 21*a* which is in contact with the underside 12*a* of the hollow portion 12, an upward surface 21*b* which is in contact with the upside 12*b*, a forward surface 21*d* which is in contact with the front 12*d*, and a rearward surface 21*e* which is in contact with the rear 12*e*, the elastic body 21 of the embodiment has its four peripheries be continuously in contact with the hollow portion 12. Such an elastic body 21 can reliably dampen vibration from the face plate 8. In addition, since a bottom surface 21*c* on the heel side of the elastic body 21 is in contact with the face receiving frame portion 9 by way of the intermediate weight member 20, vibration is further dampened. In addition, the elastic body 21 is bonded to the face receiving frame portion 9 by an adhesive or the like, for example.

Preferably, the elastic body 21 is a rubber, a resin, or an elastomer or the like, and, among others, it is desirably a thermoplastic elastomer consisting of a soft segment and a hard segment, such as a thermoplastic styrene elastomer, thermoplastic polyurethane elastomer or the like, or a thermoplastic elastomer such as nylon or the like.

In addition, hardness of the elastic body 21 is not specifically limited. However, when it is too great, the elastic body 21 tends to fail to show the ability to adequately absorb impact. On the contrary, if it is too small, durability is liable to degrade. From such a standpoint, it is desirable that the hardness (JIS-D hardness) of the elastic body 21 is preferably 40° or higher and more preferably 50° or higher, or preferably 90° or lower and more preferably 80° or lower.

FIG. 8(*a*) to FIG. 8(*c*) show other embodiments of the present invention. In the embodiment of FIG. 8(*a*), the hollow portion 12 remains as a space and nothing is provided therein. Such a head 1 can not only reduce weight but also reduces mass on the heel side, thus increasing the moment of inertia Ic. Therefore, this prevents the face from excessively returning to the position at address when a golfer swings, thereby controlling mishit shots. In addition, through allocation to other part of the weight margin obtained by forming the hollow portion 12, a position of the head center of gravity can be adjusted without increasing the head mass.

In addition, in the embodiment of FIG. 8(*b*), only the intermediate weight member 20 is arranged in the hollow portion 12, and in the embodiment of FIG. 8(*c*), only the elastic body 21 is disposed in the hollow portion 12. In this manner, the hollow portion 12 may be used in various aspects.

Although the present invention has been described above in detail, it may be changed to various aspects, as needed, without being limited to the specific embodiment described above.

EXAMPLE

In order to ensure the effect of the present invention, iron-type golf club heads having a basic configuration as shown in FIG. 1 to FIG. 4 and based on the specification in Table 1 were prototyped and various kinds of actual hitting tests were conducted on them. Each of the heads was molded by bonding, with an adhesive and through caulking, a face receiving frame portion attached to a tubular portion formed of a casting which was made by molding SUS630 (specific gravity: 7.78) with the lost-wax precision casting method, and a face plate (specific gravity: 4.5) which is a pressed mold of Ti-6A1-4V. In addition, a head main portion was manufactured so that a center of gravity position of the head main body does not change if a position and mass of a hollow portion, a heel-side weight member, and an intermediate weight member are varied. In addition, a position to fixedly set up a bottomed hole part is provided at a same position of each head, and a position to fixedly set up a bottom of a heel-side weight member is also provided at a same position of each head. In addition, a position to fixedly set up the hollow portion is changed as appropriate, for each head, depending on a distance L2. In addition, all parameters except those shown in Table 1 are identical, and listed below are main common specifications.

Head overall weight: 248 g (5-iron).
Lie angle: 61°
Loft angle: 24°
Specific gravity ρ1 of the head main portion: 7.78
Thickness t of the face plate: 3.3 mm
Heel-side weight member: A tungsten-nickel alloy (specific gravity: 18)
Toe-side weight member: A tungsten-nickel alloy (specific gravity: 9.8)
Mass of the toe-side weight member: 4.9 g
Intermediate weight member: A tungsten-nickel alloy (specific gravity: 9.8 or 18)
Binding of the faceplate and the face receiving frame portion: Press-fit
Binding of the heel-side weight member and the face receiving frame portion: Adhesion
Binding of the toe-side weight member and the face receiving frame portion: Tig welding
Binding of the intermediate weight member and the face receiving frame portion: Adhesion
Elastic body: Thermoset polyurethane (JIS-D hardness: 60 degrees)
Weight member of Comparative Example 1: 50 g Thirty-eight-inch iron clubs were prototyped by mounting an identical FRP shaft (MP-500, Flex R, manufactured by SRI Sports Limited) to each sample head. Then, actual hitting tests were conducted by five 5- to 15-handicap golfers using each test club and commercially available Three-piece Golf Ball (XXIO (trademark of SRI Sports Limited)) manufactured by the same company. Each golfer hits five balls with each test club. The directional movement, easiness to fly high, and hit feeling were evaluated in a 5-score method, and an average value thereof was calculated. The greater a numeric value is, the better the head is.

In addition, the "moment of inertia Ig" in Table 1 is the moment of inertia around the vertical axis passing through the center of gravity G of the head in the reference condition described above. Additionally, the "moment of inertia IC" in Table 1 is the moment of inertia around the axial centerline CL of the shaft inserting hole in the reference condition described above.

Table 1 shows test results, and the like.

TABLE 1

Figure 9:
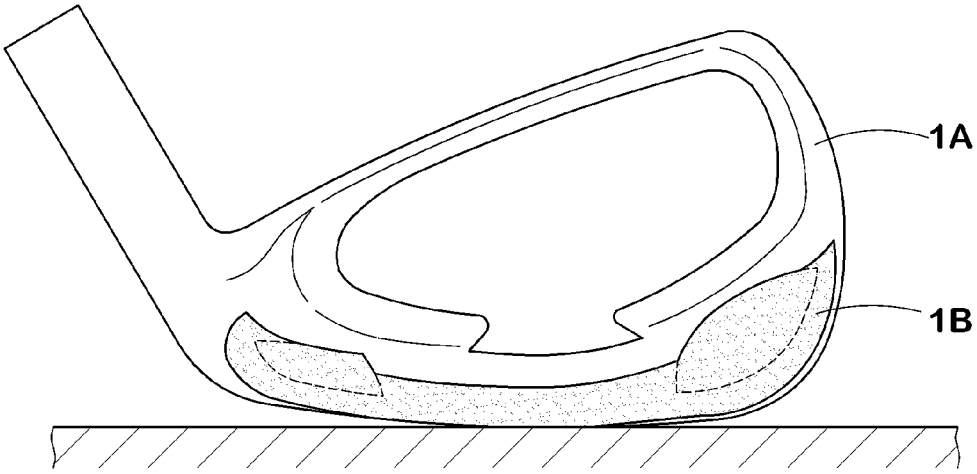
FIG. 9 is a view showing a structure of a golf club head in Comparative Example 1.
Figure 10:
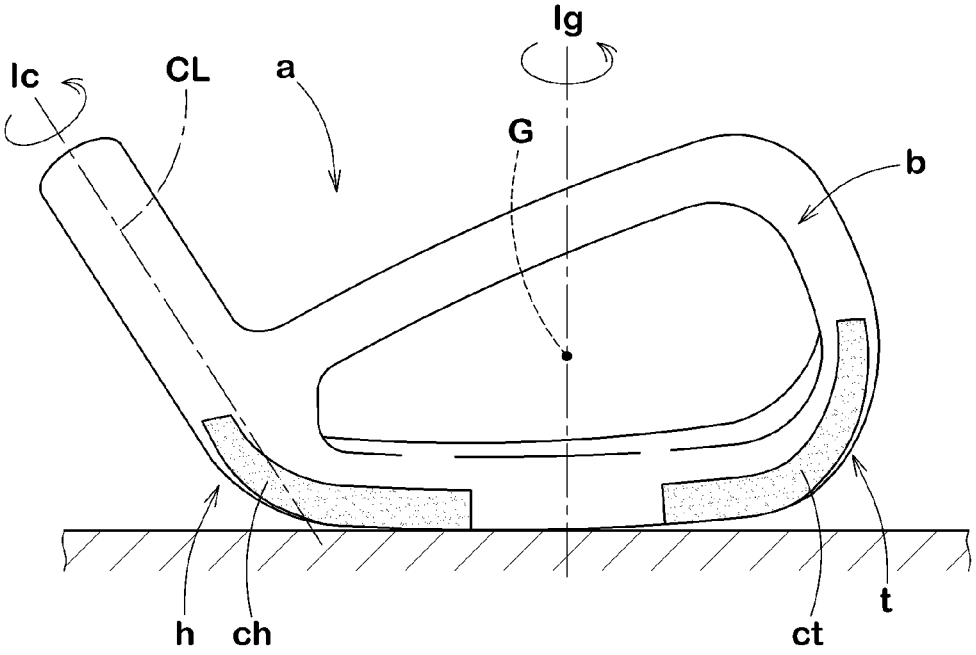
FIG. 10 is a front elevational view of a head, illustrating the prior art.

| | Com. Ex. 1 | Ex. 1 | Ex. 2 | Ex. 3 | Ex. 4 | Ex. 5 | Ex. 6 | Ex. 7 | Ex. 8 |
|---|---|---|---|---|---|---|---|---|---|
| Figures showing a structure of a club head | FIG. 9 | FIG. 2 | FIG. 2 | FIG. 2 | FIG. 2 | FIG. 2 | FIG. 2 | FIG. 2 | FIG. 2 |
| Mass of the heel-side weight member (g) | — | 6 | 8 | 15 | 16 | 12 | 12 | 12 | 12 |
| Mass of the intermediate weight member (g) | — | 1.5 | 1.5 | 1.5 | 1.5 | 1.5 | 4 | 10 | 16 |
| Distance L2 between the axial centerline of the shaft including hole and the center of gravity of the intermediate weight member (mm) | — | 9 | 9 | 9 | 9 | 9 | 9 | 9 | 9 |
| Moment of inertia Ig ($g \cdot cm^2$) | 2880 | 2900 | 2920 | 2940 | 2950 | 2940 | 3020 | 3060 | 3050 |

TABLE 1-continued

| | | | | | | | | | |
|---|---|---|---|---|---|---|---|---|---|
| Moment of inertia Ic (g · cm$^2$) | 6000 | 6100 | 6100 | 6100 | 6100 | 6100 | 6200 | 6300 | 6360 |
| Directional movement | 2.5 | 3.1 | 3.2 | 3.3 | 3.4 | 3.3 | 3.5 | 3.7 | 3.6 |
| Easiness to fly high | 3 | 3 | 3 | 2.9 | 2.7 | 3 | 3.2 | 3.4 | 3.2 |
| Hit feeling | 3 | 3.5 | 3.5 | 3.5 | 3.4 | 3.5 | 3.5 | 3.5 | 3.5 |

Figure 8A:
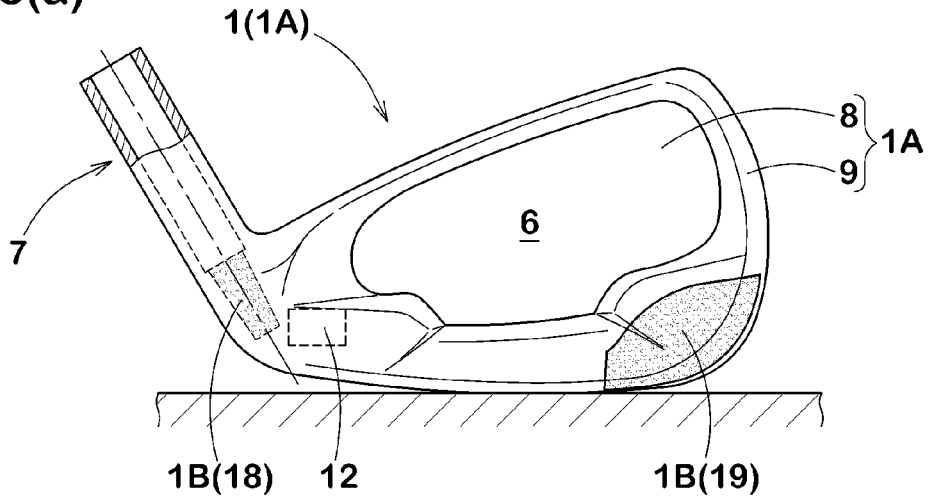
FIG. 8(*a*), FIG. 8(*b*), and FIG. 8(*c*) are rear elevational views of other embodiments of the present invention.
Figure 8B:
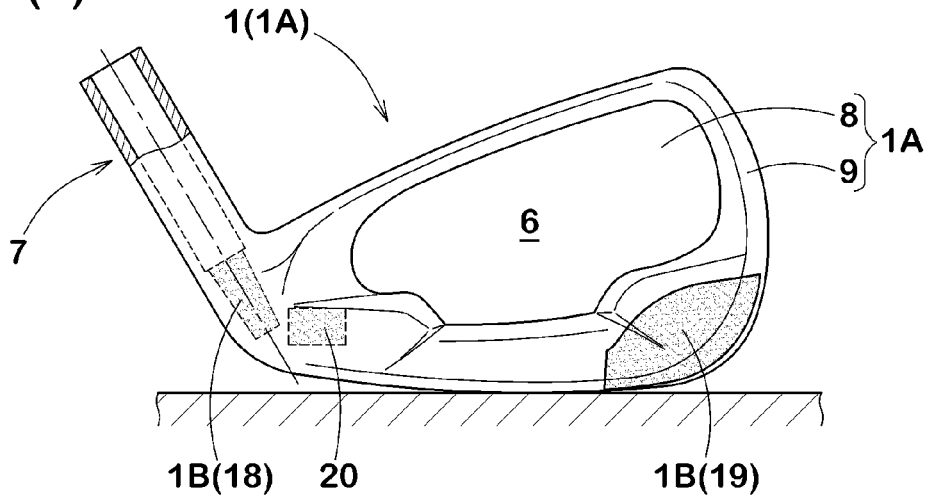
Figure 8C:
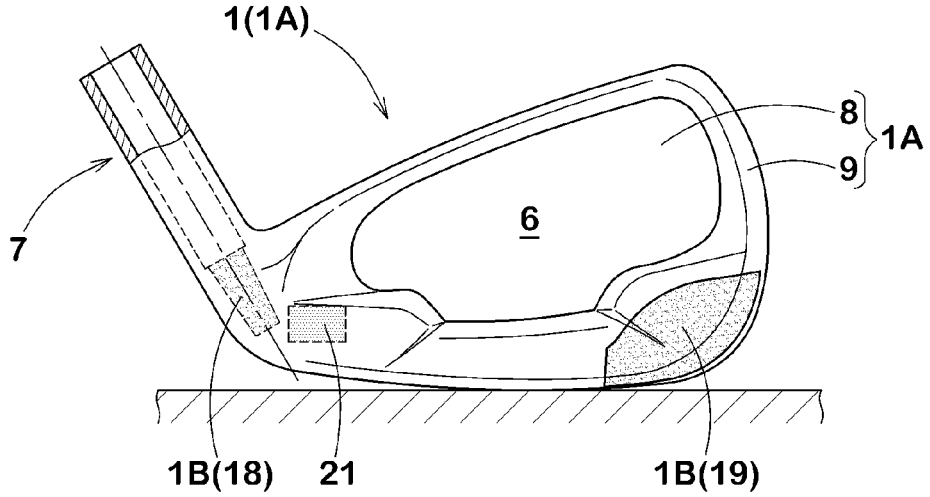

| | Ex. 9 | Ex. 10 | Ex. 11 | Ex. 12 | Ex. 13 | Ex. 14 | Ex. 15 | Ex. 16 | Ex. 17 |
|---|---|---|---|---|---|---|---|---|---|
| Figures showing a structure of a club head | FIG. 2 | FIG. 2 | FIG. 2 | FIG. 2 | FIG. 2 | FIG. 2 | FIG. 8(a) | FIG. 8(b) | FIG. 8(c) |
| Mass of the heel-side weight member (g) | 12 | 12 | 12 | 12 | 12 | 12 | 12 | 12 | 12 |
| Mass of the intermediate weight member (g) | 7 | 7 | 7 | 7 | 7 | 7 | 0 | 7 | 0 |
| Distance L2 between the axial centerline and the center of gravity of the intermediate weight member (mm) | 9 | 10 | 12 | 14 | 16 | 13 | 13 | 13 | 13 |
| Moment of inertia Ig (g · cm$^2$) | 3080 | 3070 | 3060 | 3030 | 3020 | 3040 | 2920 | 3050 | 2920 |
| Moment of inertia Ic (g · cm$^2$) | 6200 | 6240 | 6320 | 6400 | 6550 | 6350 | 6400 | 6350 | 6380 |
| Directional movement | 3.8 | 3.8 | 3.7 | 3.6 | 3.3 | 3.7 | 2.7 | 3.7 | 2.7 |
| Easiness to fly high | 3.4 | 3.3 | 3.4 | 3.2 | 3.2 | 3.3 | 3 | 3.3 | 3 |
| Hit feeling | 3.5 | 3.7 | 3.9 | 4 | 3.5 | 4 | 3 | 3 | 4.5 |

As a result of the tests, it can be confirmed that for the iron-type golf club head of the embodiment, the directional movement and the easiness for a golf ball to fly high have been significantly improved, compared with comparative Example.

What is claimed is:

1. An iron-type golf club head, comprising:

a head main portion having a face for hitting a golf ball and a tubular portion provided on a heel side of the face and having a shaft inserting hole, wherein the head main portion includes a face plate which constitutes a main part of the face, and a face receiving frame portion which has an opening that penetrates forward and backward and which only supports a periphery of the face plate, around the opening, and wherein on the face receiving frame portion is disposed a heel-side hollow portion which extends from the opening through the inside of the face receiving frame portion to the heel side, the front/back and top/bottom of the heel-side hollow portion being closed; and weight members made of a metallic material having heavier specific gravity than that of the head main portion, wherein the tubular portion is provided continuously on the lower side of the shaft inserting hole with a bottomed hole part for arranging the weight members, and the weight members include a heel-side weight member disposed in the bottomed hole part.

2. The iron-type golf club head according to claim 1, wherein the heel-side weight member is tapered toward the lower part.

3. The iron-type golf club head according to claim 1, wherein the hollow portion remains as a space.

4. The iron-type golf club head according to claim 1, wherein in the hollow portion is disposed an intermediate weight member made of a metallic material which has heavier specific gravity than that of the face receiving frame portion.

5. The iron-type golf club head according to claim 1, wherein in the hollow portion is disposed an elastic body for absorbing vibration when a golf ball is hit.

6. The iron-type golf club head according to claim 1, wherein in the hollow portion is disposed an intermediate weight member made of a metallic material which has heavier specific gravity than that of the face receiving frame portion and an elastic body for absorbing vibration when a golf ball is hit.

7. The iron-type golf club head according to claim 1, wherein the weight members include a toe-side weight member arranged on the toe side of the head main portion.

* * * * *